United States Patent [19]

Jones

[11] Patent Number: 4,806,038

[45] Date of Patent: Feb. 21, 1989

[54] KNOCK TYPE MECHANICAL PENCIL CONNECTION

[75] Inventor: Owen S. Jones, Janesville, Wis.

[73] Assignee: Parker Pen (Benelux) B.V., East Sussex, England

[21] Appl. No.: 112,295

[22] Filed: Oct. 26, 1987

[51] Int. Cl.[4] ..... B43K 15/00; B43K 21/00

[52] U.S. Cl. ..... 401/86; 401/65; 401/251; 411/517; 411/521

[58] Field of Search ..... 401/86, 94, 67, 65, 401/251; 411/517, 521

[56] References Cited

U.S. PATENT DOCUMENTS

| | | | |
|---|---|---|---|
| 278,201 | 5/1883 | Tegardine | 401/251 X |
| 1,735,224 | 11/1929 | Wahl | 401/251 |
| 2,119,645 | 6/1938 | Pearson | 401/251 |
| 2,213,033 | 8/1940 | Ashmore | 401/251 |
| 2,883,967 | 4/1959 | Tessier | 401/86 |
| 3,492,077 | 1/1970 | Tessier | 401/86 |

FOREIGN PATENT DOCUMENTS

| | | | |
|---|---|---|---|
| 823861 | 12/1951 | Fed. Rep. of Germany | 401/94 |
| 1017334 | 12/1952 | France | 401/251 |
| 1176946 | 4/1959 | France | 401/94 |
| 8798484 | 6/1984 | Japan . | |

*Primary Examiner*—Steven A. Bratlie

*Attorney, Agent, or Firm*—James N. Videbeck

[57] ABSTRACT

The lead reservoir and feed mechanism of a knock type mechanical pencil is secured to the tubular barrel in which it is housed by a resilient locking sleeve positioned in a groove near the front of the feed mechanism and a spring compressed between a rearwardly facing internal abutment on the feed mechanism. The spring urges the lead reservoir and feed mechanism rearwardly into the barrel to a position where an external flange on the locking sleeve abuts the front end of the barrel.

10 Claims, 2 Drawing Sheets

KNOCK TYPE MECHANICAL PENCIL CONNECTION

The present invention relates in general to mechanical pencils of the type having a combined lead reservoir and lead feed mechanism mounted in a tubular outer barrel, and it relates in particular to a mechanical pencil of this general type having new and improved means securing the lead reservoir and feed mechanism to said barrel to prevent inadvertent disassembly of the pencil.

BACKGROUND OF THE INVENTION

Mechanical pencils of the push-push or knock type as they are known in the writing instrument industry have employed a snap ring disposed in an annular groove near the front end of the lead feed mechanism to retain the reservoir and feed mechanism in its rearwardmost position with the ring being pressed against the front end of the barrel by a coil spring mounted within the barrel in compression between a rearwardly facing shoulder on the barrel and a forewardly facing shoulder on the reservoir and feed mechanism. Pencils of this type have been marketed by the assignee of the present invention, but they have sometimes become inadvertently disassembled because of accidental dislodgement of the snap ring. One cause of this dislodgement of the ring has been its tendency to twist in the annular groove in which it is retained and pop out of the groove.

SUMMARY OF THE INVENTION

Briefly, there is provided in accordance with the teachings of the present invention a radially resilient sleeve which is disposed in an annular groove in the lead feed mechanism and which has an outwardly projecting stop surface at its foreward end which engages the front end of the barrel to limit rearward movement of the reservoir and lead feed mechanism in the barrel. A spring mounted within the barrel urges the feed mechanism rearwardly to the position where the projecting stop surface engages the front end of the barrel.

The annular groove has a shallow front section which underlies the foreward end of the sleeve to maintain the stop surface in the outwardly extended position in engagement with the front end of the barrel. The groove has an adjacent intermediate section which is sufficiently deep to permit compression of the forward end of the sleeve therein when the intermediate section of the annular groove underlies the foreward end of the sleeve. When the front end of the sleeve is compressed into the intermediate portion of the groove the outer diameter of the stop surface is less than the inner diameter of the nose of the barrel whereby the reservoir and feed mechanism can be withdrawn from the rear end of the barrel.

The annular groove also has a shallow rear section which receives the rear portion of the sleeve to prevent twisting of the sleeve relative to the reservoir and feed mechanism. The rear section of the annular groove has a sufficient length to permit movement of said intermediate section beneath the foreward end of said sleeve when it is desired to disassemble said pencil.

GENERAL DESCRIPTION OF THE DRAWINGS

The present invention will be better understood by a reading of the following detailed description taken in connection with the accompanying drawings wherein.

DETAILED DESCRIPTION OF A PREFERRED EMBODIMENT

Figure 1:
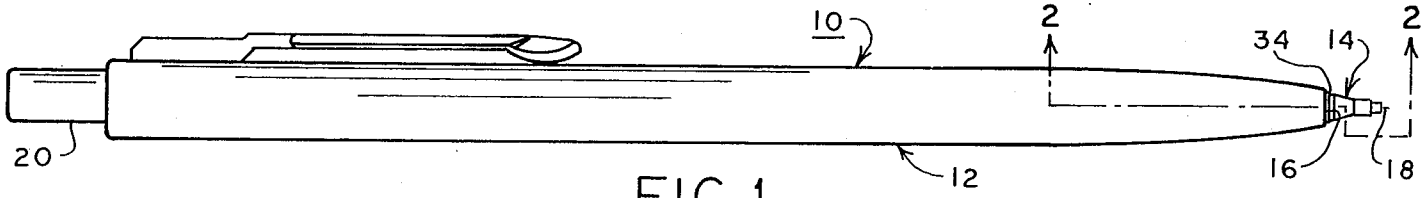
FIG. 1 is a side view of a mechanical pencil embodying the present invention.

There is shown in FIG. 1 a mechanical pencil 10 comprising as its principal parts an elongate barrel 12 which is generally tubular in construction and which houses a lead reservoir and feed mechanism 14 having a foreward portion which extends forewardly from the front end or nose 16 of the barrel. The lead reservoir and feed mechanism 14 is of a type well known in the art and supports a writing lead stick 18 which extends from the foreward end thereof. Mounted within the barrel 10 and extending from the rear end thereof is a depressible push button 20 which when depressed causes the stick of lead 18 to move forewardly relative to the lead reservoir and feed mechanism 14. When the button 20 is released and moves to its retracted position the jaws of a clutch mechanism engage the piece of lead 18 and prevent it from moving relative to the lead reservoir and the feed mechanism 14.

The lead reservoir and feed mechanism is a separate unit which is inserted into the barrel at the time of manufacture and need not be removed from the barrel thereafter except for repair of the pencil. Many different ways have been used to secure the lead reservoir and feed mechanism to the barrel including the use of a snap ring mounted in an annular groove in the forward end portion of the lead reservoir and feed mechanism for engagement with the nose of the barrel to prevent inadvertent rearward movement of the lead reservoir and feed mechanism into the barrel. This securing system is shown in Japanese Utility Model Public Disclosure No. 87984/84 over which the present invention is an improvement.

Figure 2:
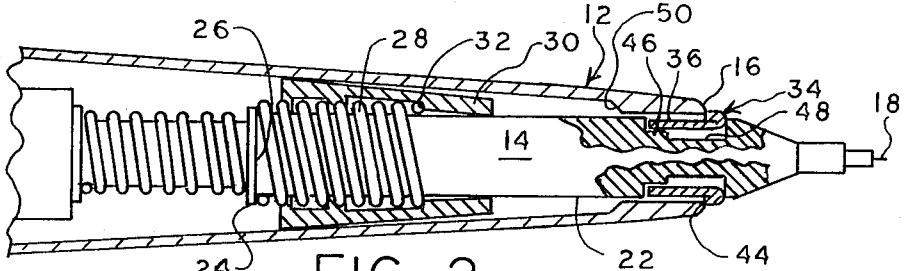
FIG. 2 is a longitudinally cross-sectioned view of the front end of the pencil shown in FIG. 1, it being taken along the line 2—2 of FIG. 1.

Referring to FIG. 2, it may seen that the lead reservoir and feed mechanism 14 includes a forward tubular portion 22 which has at its rearward end an external annular flange 24 which provides a forewardly facing shoulder 26 which is abutted by the rear end of a coil spring 28 which surrounds the rearward end portion of the tubular part 22. An annular tip bushing 30 is fitted into the foreward end of the barrel 12 and has a rearwardly facing annular shoulder 32 against which the foreward end of the spring 28 abuts when the spring 28 is in the slightly compressed position as shown in FIG. 2.

Figure 3:
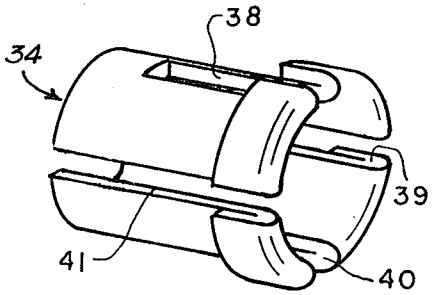
FIG. 3 is a perspective view of the locking sleeve used in the pencil of FIG. 1.
Figure 4:
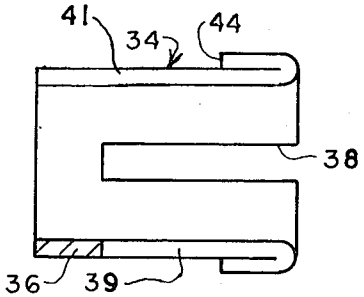
FIG. 4 is a longitudinally cross-sectioned view of the locking sleeve of FIG. 2.
Figure 7A:
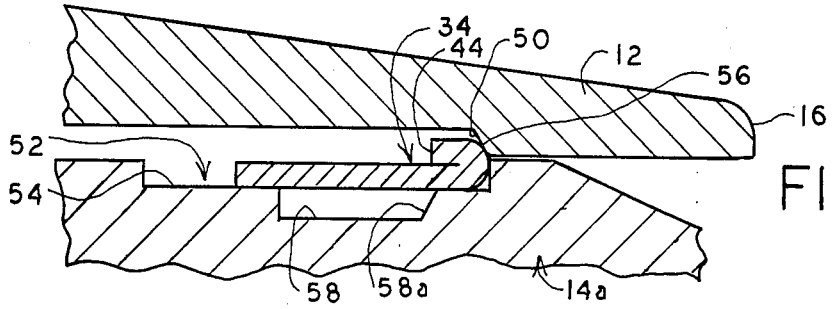
Figure 7B:
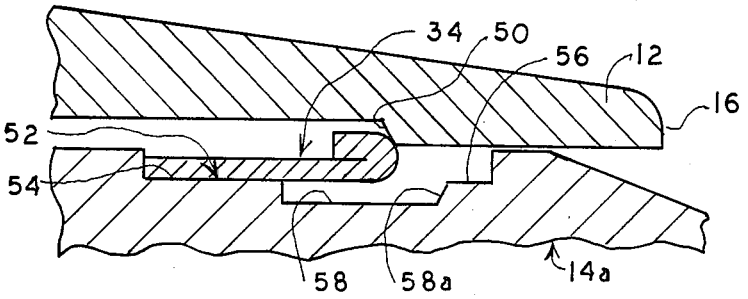
Figure 7C:
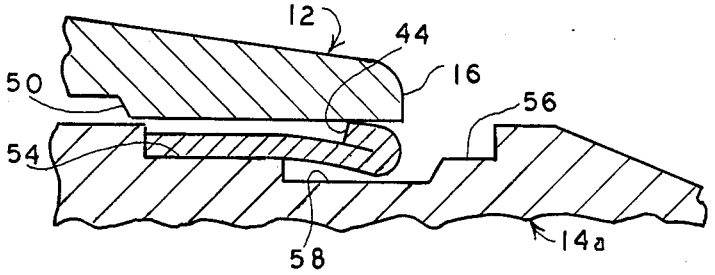
Figure 7D:
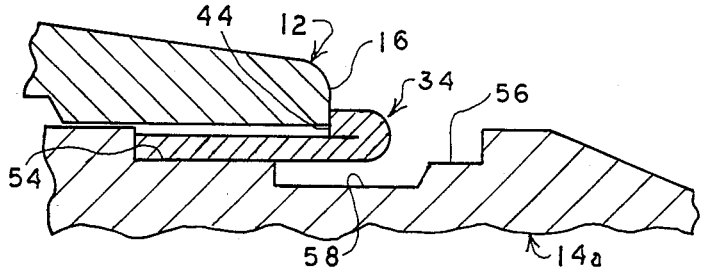
Figure 7E:
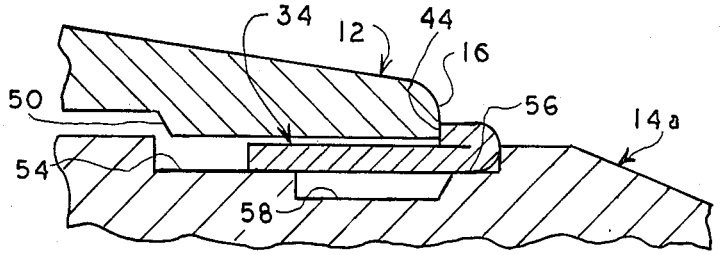

In order to prevent the spring 28 from forcing the lead reservoir and feed mechanism 14 into the barrel 12, a locking sleeve 34 is mounted to the mechanism 14 and abuts the nose portion 16 of the barrel 12. Considered in greater detail, the sleeve 34 has a generally tubular body portion 36 which as best shown in FIGS. 3 and 4 is provided with two pairs of diametrically opposite longitudinal slits 38, 39, 40 and 41. The slit 41 extends throughout the full length of the sleeve 34 while the slits 38, 39 and 40 extend from the front end of the locking sleeve 34 only to a location near the rear of the sleeve. The slits render sleeve 34 radially compressible. The sleeve 34 is formed of spring metal whereby it is resilient, and the forward end thereof is folded back onto itself to provide radially projecting, rearwardly facing stop surfaces 44 which engage the front end 16 of the barrel 12 when the sleeve 34 is in its relieved, expanded condition as shown in FIG. 2. As may be seen in FIG. 2 the sleeve 34 is fitted into an annular groove in the foreward portion of the lead reservoir and feed mechanism 14. The rearward portion of the groove is identified by the reference numeral 46 and is relatively shallow so as to hold the sleeve in position and prevent it from being twisted as had been the case with snap rings The foreward portion of the groove is identified by the reference numeral 48 and is sufficiently deep so that the foreward end of the sleeve and particularly the flange 44 may be pressed into the foreward end of the groove 48 so that the outer diameter of the foreward end of the sleeve 34 is less than the inner diameter of the nose portion 16 of the barrel thereby to permit assembly of the mechanism 14 into the barrel and disassembly of the mechanism 14 therefrom.

In order to facilitate assembly of the pencil and to permit assembly of the sleeve 34 onto the mechanism 14 before the mechanism 14 is assembled to the barrel 12, the barrel is provided with a tapered or camming annular shoulder 50 which faces rearwardly and against which the curved foreward end of the sleeve 44 engages as the lead reservoir and feed mechanism 14 is initially inserted into the barrel from the left hand side to the right hand side as shown in FIG. 2. As the mechanism 14 is pressed forewardly in the barrel, the nose portion of the sleeve 34 is cammed into the deep portion 48 of the groove and clears the inside diameter of the nose portion of the barrel. When the mechanism 14 has been pushed a sufficient distance forward so that the shoulder 44 is foreward of the nose 16 of the barrel, the sleeve 34 expands outwardly and thereafter prevents rearward movement of the mechanism 14 relative to the barrel 12. The spring 28 is at that time in a slightly compressed state and thereby holds the mechanism at its rearwardmost position so that no looseness or movement of the mechanism 14 relative to the barrel is noticeable to the user.

Figure 6:
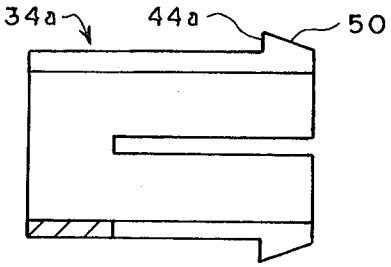
FIG. 6 is a longitudinally cross-sectioned view of an alternative locking sleeve, and FIGS. *7a* through *7e* are cross-sectional views showing a sequence of operating positions of the lead feed mechanism, the locking sleeve and the nose of the outer barrel during assembly of another emdoiment of the invention.
Figure 5:
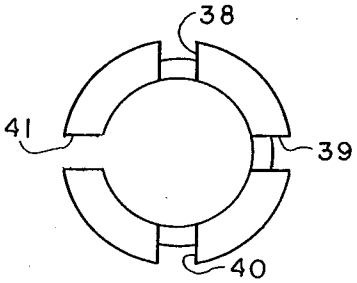
FIG. 5 is a front end view of the locking sleeve of FIG. 3.

In FIG. 6 there is shown a modified sleeve 34A which is substantially the same as the sleeve 34 except that the sleeve 34A is formed of plastic and the foreward end includes an external annular flange having a rearwardly facing shoulder 44A and a forewardly facing tapered or cam surface 50. Like the sleeve 34, the sleeve 34A is provided with a purality of longitudinal slits so that it may be radially compressed to permit movement thereof through the foreward portion of the associated barrel.

The sleeves 34 and **34*a* are shown to have one full length slit 41 and three shorter longitudinal slits 38, 39 and 40**. However, a greater or lesser number of slits may be used as long as the sleeve is sufficiently compressible to fit into the groove to permit movement of the lead reservoir and feed mechanism through the front end of the barrel during assembly and disassembly of the pencil.

Referring to FIGS. *7a*, *7b*, *7c*, *7d* and *7e* there is shown an alternative embodiment of the invention which further prevents inadvertent removal of the lead reservoir and feed mechanism from the barrel. As there shown, the barrel 12 encloses a lead reservoir and feed mechanism 14A which is provided with an elongate locking sleeve receiving annular groove 52 which receives the locking sleeve 34. The groove 52 has a shallow rear portion 54, a shallow foreward portion 56 and a relatively deep intermediate portion 58. The depth of the intermediate portion 58 is greater than the maximum radial thickness of the locking sleeve 34. The foreward end of the intermediate groove portion 58 is forewardly tapered as shown at 58A and the length of the foreward groove portion 56 and the longitudinal length of the tapered surface 58A is less than the distance between the rear end of the sleeve 34 and the rear end of the groove 54 when the locking sleeve is in its most foreward position in the groove 52 as shown in FIG. 7. The reason for the criticality of these relative dimensions will become clear as the description of the operation of this embodiment of the invention proceeds.

As shown in FIG. *7a*, the lead reservoir and feed mechanism **14*a* is being initially inserted into the barrel 12 and the foreward end of the sleeve 34 has engaged the cam surface 50 on the internal wall of the barrel 12. As the mechanism 14*a* is pushed further forewardly through the barrel, the position of the locking sleeve 34 relative to the barrel 12 remains fixed until the rear end of the groove 52 engages the rear end of the sleeve 34** as illustrated in FIG. *7b*. Further movement of the mechanism 14 through the barrel now causes the foreward end of the sleeve 34 to be cammed into the intermediate section 58 of the groove so that the sleeve 34 may pass freely through the reduced diameter of the forward portion of the barrel 12. When the rear stop surface 44 on the sleeve 34 is pushed forewardly of the front end 16 or nose portion of the barrel the resiliency of the sleeve 34 causes it to expend outwardly as shown in FIG. *7d*. Then the natural resiliency of the spring 28 (not shown in FIG. 7) pushes the lead reservoir and feed mechanism rearwardly to the final position as shown in FIG. *7e* wherein the shallow foreward portion 56 of the groove 58 underlies the front end of the sleeve 34 and prevents compression of the sleeve.

In order to disassemble the pencil it is merely necessary to push the mechanism **14*a*** forewardly into the position shown in FIG. *7d* and then by means of a tool or the like compress the front end portion of the sleeve 34 into the intermediate section **58*a* of the groove 52 and hold it in that position as the mechanism 14*a*** is retracted through the foreward nose portion of the barrel.

It may thus be seen that in accordance with the present invention there is provided an improved mechanism for securing the lead reservoir and the feed mechanism of a knock type pencil in the barrel of the pencil. The provision of the spring lessens the need for close tolerances in the sleeve receiving groove and the multiple depth groove in the embodiment of FIGS. *7a–7e* prevents inadvertent disassembly of the pencil.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed:

1. A mechanical pencil of the type having an elongate lead reservoir and feed mechanism mounted from the rear with an elongate outer barrel with the forward end of said mechanism defining a tip, said tip extending through an opening at the front end of said barrel, comprising in combination an external stop surface disposed on said lead reservoir and feed mechanism within said barrel and facing toward the front end of said barrel, a rearwardly facing abutment surface interiorly of said barrel, resilient means compressed between said abutment surface and said stop surface for urging said lead reservoir and feed mechanism rearwardly in said barrel, an external annular groove on said tip of said lead reservoir and feed mechanism said annular groove extending from a location rearward of said forward end of said barrel to a location forward of said front end of said barrel, a resilient, radially compressible, elongate locking sleeve disposed o said annular groove, and being compressible radially inwardly on said groove during the mounting of said feed mechanism in said barrel, said sleeve having at the forward end thereof radially extending stop means engaging the front end of said barrel to limit rearward movement of said lead reservoir and feed mechanism in said barrel, and said sleeve having a rearward tubular portion extending a substantial distance into said barrel from said front end to retain said sleeve on said groove.

2. A mechanical pencil according to claim 1 wherein the width of said annular groove is greater than the axial length of said sleeve.

3. A mechanical pencil according to claim 2 wherein a portion of said annular groove disposed rearwardly of said front end of said barrel is deeper than the thickness of the forward end of said sleeve to permit compression of the forward end of said sleeve into said groove with said radially extending stop means being located interiorally of said opening at the front end of said barrel when said lead reservoir and feed mechanism is in its forwardmost position in said barrel.

4. A mechanical pencil according to claim 3 comprising a rearwardly facing annular camming shoulder in said barrel disposed rearwardly of said opening, and said stop means on said sleeve having a forwardly facing camming surface for engagement with said annular camming shoulder to compress said sleeve when said lead reservoir and feed mechanism is initially inserted into said barrel from the rear end thereof to push said sleeve partially through said front end of said barrel until said stop means are disposed forwardly of said front end.

5. A mechanical pencil according to claim 2 wherein said sleeve is provided with at least one longitudinal slot extending rearwardly from the foreward end of said sleeve to permit radial compression of said sleeve, said stop means being respectively disposed near the forward end portion of said sleeve.

6. A mechanical pencil according to claim 5 wherein a portion of said annular groove disposed rearwardly of a forward portion thereof is shallower than said forward portion, and a forwardly facing annular shoulder disposed on said lead reservoir and feed mechanism between said rearward and said forward portions of said annular groove.

7. For use in a mechanical pencil of the type having an elongate lead reservoir and lead feed cartridge mounted with an elongate outer barrel within the forward writing end of said cartridge extending through an opening at the front end of said barrel, an improved lead reservoir and lead feed cartridge comprising in combination an external annular groove in said cartridge disposed near said forward writing end, a generally tubular, radially compressible sleeve mounted in said groove, said sleeve having an external, rearwardly facing stop surface near forward end thereof for selective engagement with said barrel, said groove having an intermediate section and spaced front and rear sections, said intermediate section being deeper than said front and rear sections.

8. The combiantion of claim 7 wherein the longitudinal length of said sleeve is greater than the combined lengths of said front and intermediate sections of the groove.

9. The combination of claim 8 wherein the longitudinal dimension of said annular, groove is greater than the combined lengths of said front section and said sleeve.

10. The combination of claim 9 wherein, said front section of said annular groove has an inclined annular surface at the rearward end connecting to said intermediate section.

* * * * *